340-539
8/28/79 XR 4,166,273

United States Patent [19]

Riley, Jr. et al.

[11] 4,166,273

[45] Aug. 28, 1979

[54] INTRUSION DETECTOR SYSTEM

[75] Inventors: Robert E. Riley, Jr., Jackson; Barrie McArthur, Canton, both of Mich.

[73] Assignee: Diversified Technology, Inc., Ridgeland, Mich.

[21] Appl. No.: 834,119

[22] Filed: Sep. 19, 1977

[51] Int. Cl.[2] ..... G08B 13/22

[52] U.S. Cl. ..... 340/539; 340/541; 340/552; 340/558; 340/568; 325/64

[58] Field of Search ..... 340/213 R, 224, 276, 340/412, 539, 541, 551, 552, 553, 558, 559, 568, 570; 325/30, 45, 64

[56] References Cited

U.S. PATENT DOCUMENTS

| | | | |
|---|---|---|---|
| 3,230,454 | 1/1966 | Burkleo | 340/224 |
| 3,774,190 | 11/1973 | Kyle, Jr. | 340/224 |

*Primary Examiner*—Alvin H. Waring
*Attorney, Agent, or Firm*—Cohn, Powell & Hind

[57] ABSTRACT

An intrusion detector system for detecting the presence of moving targets in one or more surveillance zones and activated either by the presence of the moving target or directly by some positive action for transmitting an alarm signal causing the provision of a predetermined number of pulses having predetermined time periods. A tone generator and control circuitry receiving the timed pulses, generates a combination of multiple tones of discreetly different frequencies during the timed pulses, the combination of multiple tones of each timed pulse being of different frequencies than the combination of multiple tones of each other timed pulse, to provide a tone-coded message that is transmitted to a receiver. Control circuitry of the processor, in response to the initial reception of the tone-coded message, provides a predetermined number of pulses having predetermined time periods compatible with the pulses of a valid tone-coded message so as to have substantially coincident time frames in which appropriate multiple tones can be present, and is operative in response to a particular combination of multiple tones present in each time frame in sequence to provide an output alarm indication.

6 Claims, 4 Drawing Figures

INTRUSION DETECTOR SYSTEM

BACKGROUND OF THE INVENTION

This invention relates generally to improvements in an intrusion detector system, and more particularly to an improved system utilizing a stake-out unit containing an RF transmitter and a processor containing an RF receiver.

The heretofore conventional intrusion alarm systems were subject to providing faulty or false alarm situations. For example, transmitted signals from transmitters other than the system stake-out transmitter could trigger the processor into providing an alarm indication. Moreover, in these prior systems, the stake-out unit was not totally self-contained in that it would operate for both burglary and armed robbery, and would not in addition to reporting the incident, gather other evidence of the incident.

SUMMARY OF THE INVENTION

The present intrusion detector system determines the message validity transmitted between the transmitter in the stake-out unit and the receiver in the processor, and thereby avoids any false alarm situation. Moreover, the stake-out unit is totally self-contained and will operate for both burglary and armed robbery, and in addition to reporting the incident, will gather evidence in the form of audio recordings and photographs of the incident.

The present intrusion detector system includes means for transmitting an alarm signal which causes other means in response to the alarm signal to provide a predetermined number of pulses having predetermined time periods. A tone generator and associated control circuitry receives the timed pulses and generates a combination of multiple tones of discreetly different frequencies during the timed pulses, the combination of multiple tones of each timed pulse being of different frequencies than the combination of multiple tones of each other times pulse, to provide a tone-coded message. The tone-coded message is transmitted by the stake-out unit.

The processor includes a receiver operative to receive the tone-coded message. The processor circuitry is operative in response to the initial receiption of the tone-coded message to provide a predetermined number of pulses having predetermined time periods compatible with the pulses of a valid tone-coded message so as to have substantially coincident time frames during which appropriate multiple tones can be present, such circuitry being operative in response to a particular combination of multiple tones present in each time frame in sequence to provide a output alarm indication.

The stake-out unit includes a robbery transmitter that is directly activated to provide a first alarm signal, and an intrusion transmitter for transmitting a signal into a zone under surveillance and for receiving a signal from the zone to provide a second alarm signal in response thereto. Means in the circuitry providing the timed pulses is activated by the second alarm signal, and the means in the circuitry receiving the timed pulses activates the tone generator to provide a multiple tone combination during one timed pulse to indicate a burglary, and receives the first alarm signal to activate the tone generator to provide a different multiple tone combination during the said one timed pulse to indicate a robbery.

A camera is operative in response to the first alarm signal to photograph the robbery zone.

Recording means is operative in response to an alarm signal for transmitting a predetermined message after transmission of the tone-coded message, and for recording all sounds in the surveillance zone.

The processor includes a receiver operative to receive the tone-coded message. The processor circuitry is operative in response to the reception of the first multiple tone, timed pulse of the tone-coded message for providing an electrical start signal that actuates means in the circuitry to provide a predetermined number of pulses having predetermined time periods compatible with the other pulses of a valid tone-coded message so as to have substantially coincident time frames in order to validate the tone-coded message. Gating means in the processor circuitry is operative in response to the particular combination of multiple tones present in each substantially coincident time frame in time sequence to provide an output alarm indication.

The processor circuitry also includes a timing gate means operative in response to the electrical start signal for providing a predetermined time period in which the other pulses of the tone-coded message must be received in order to validate the message.

DESCRIPTION OF THE PREFERRED EMBODIMENT

Figure 1:
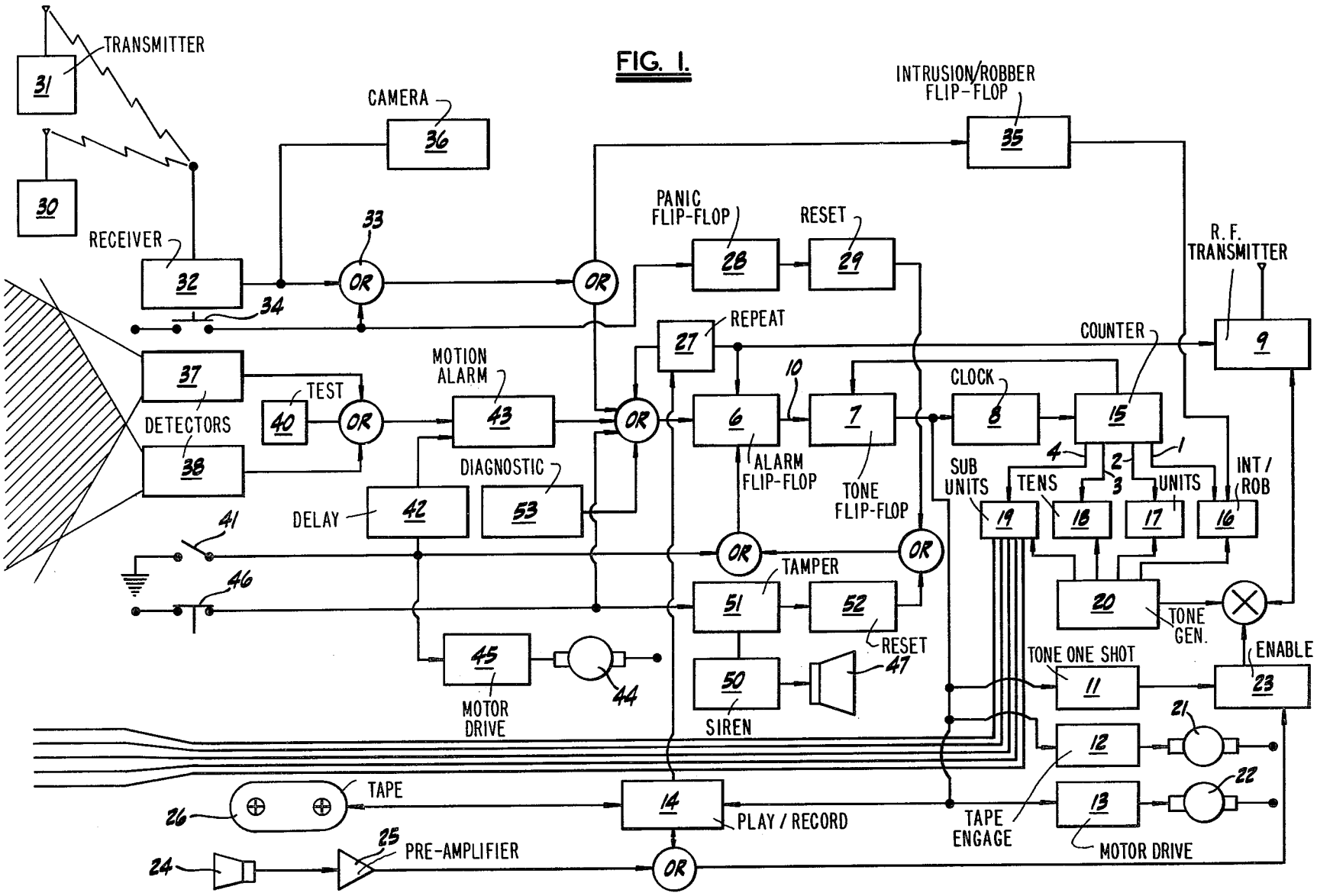
FIG. 1 is a block diagram of a stake-out unit of the alarm system.
Figure 2:
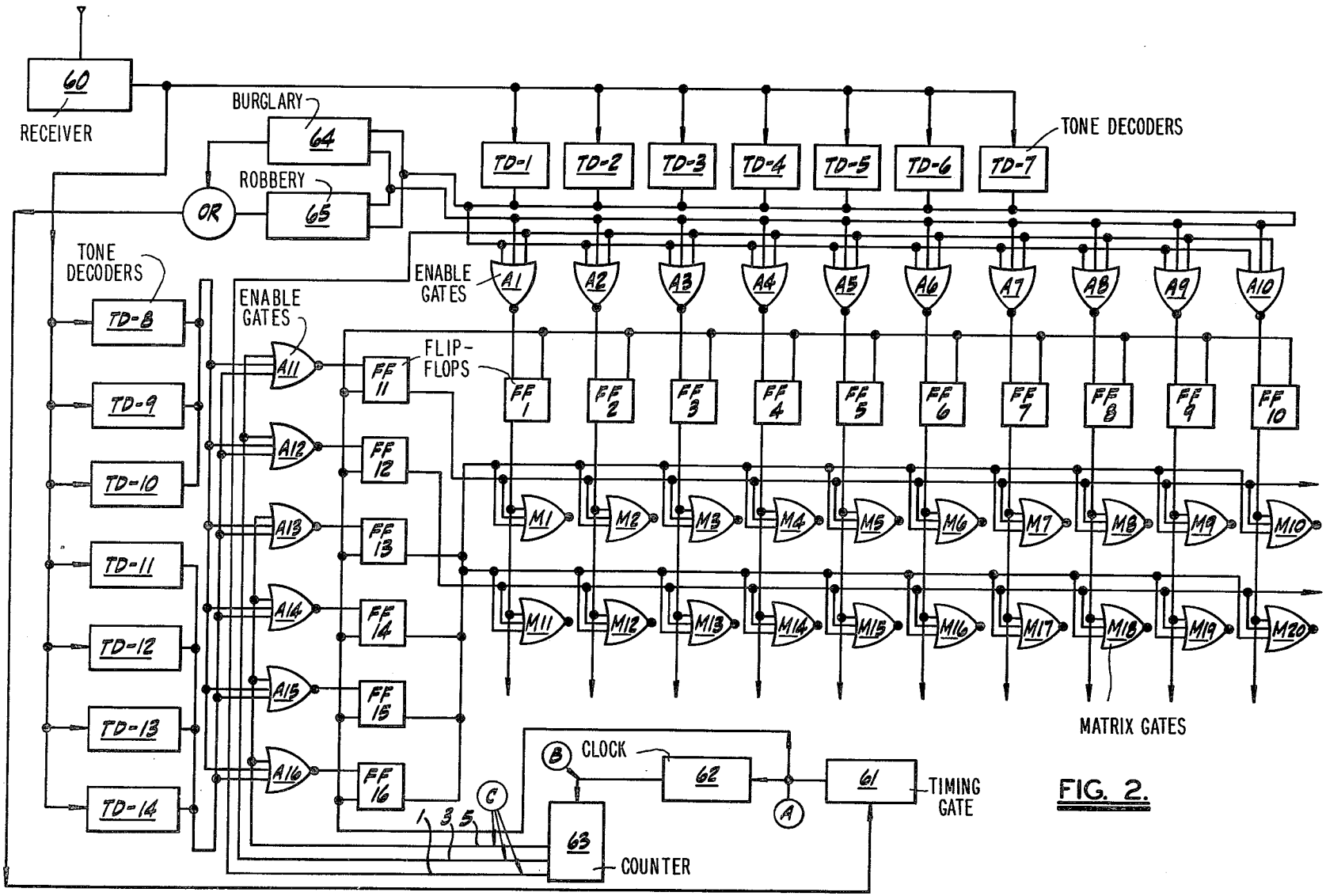
FIG. 2 is a block diagram of a processor of the alarm system.

Referring now by characters of reference to the drawings, and first to FIG. 1, that portion of the circuitry of the stake-out unit which functions the same when an alarm is activated, regardless of the triggering device, will be referred to as the alarm state circuitry. Reference point 10 is located between the alarm flip-flop 6 and the tone flip-flop 7. Although several occurrences can cause the alarm flip-flop 6 to set, the sequence of events after the alarm flip-flop 6 is set remains the same regardless of the occurrence that initially causes the alarm.

When the event sets the alarm flip-flop 6, the transmitter 9 is immediately keyed on. The output of the alarm flip-flop 6 is delayed by one-tenth of a second and then sets the tone flip-flop 7. This delay allows the transmitter 9 to be keyed on prior to being modulated by the audio input. The tone flip-flop 7 output initiates five elements of the circuitry, i.e., the clock 8, the tone message one shot circuit 11, the tape head engage circuit 12, forward motor drive circuit 13, and the play/-record circuit 14.

The tone flip-flop 7 initiates the clock 8. The clock 8 is an astable multi-vibrator with a time period of one hundred milliseconds. The one hundred millisecond clock 8 provides the input to the decade counter 15. The decade counter 15 acts as a manifold. Output number (1) of the decade counter 15 goes high for the first three clock pulses. The fourth clock pulse causes no output. The fifth clock pulse causes output number (2) to go high. The sixth clock pulse causes no output. The seventh clock pulse causes output number (3) to go out. The eighth clock pulse causes no output. The ninth clock pulse causes output number (4) to go high. In summary, the decade counter 15 puts out a long pulse to the intrusion/robbery select circuit 16, followed by a short pulse to the units select circuit 17, tens select circuit 18 and sub-units select circuit 19, in that order.

The intrusion/robbery select circuit 16 has the function of controlling the tone generator 20 during the first message pulse. The tone generator 20 will output a tone pair of 941 hz and 1209 hz for a robbery command, and a tone pair of 941 hz and 1477 hz for a burglary command. The units select circuit 17 has the function of controlling the tone generator 20 during the second message pulse. The tone generator will output a tone pair corresponding to the number programmed into the units select circuit 17, i.e., if the units select circuit 17 is programmed for the number "3" the corresponding tone pair will be 770 hz and 1209 hz.

The tens select circuit 18 has the function of controlling the tone generator 20 during the third message pulse. The tone generator 20 will output a tone pair corresponding to the number programmed into the ten select circuit 18, i.e., if the units select circuit 17 is programmed for number "1" the corresponding tone pair will be 697 hz and 1336 hz.

The table below is representative of a possible tone matrix versus corresponding numbers programmed:

| | 1209 | 1336 | 1477 |
|---|---|---|---|
| 697 | 0 | 1 | 2 |
| 770 | 3 | 4 | 5 |
| 852 | 6 | 7 | 8 |
| 941 | ROB. | 9 | INT. |

In summary, the tone generator 20 is the heart of the tone portion of the transmitted tone-coded message. The clock 8 and decade counter 15 provide the time sequencing, the select circuits 16–18 provide the programming for the tone generator 20, and the tone generator 20 provides the discreet tone pair generation. Preferably, the clock 8 sequences the decade counter 15 twice and is then reset. This allows two identical tone-coded messages to be transmitted.

Although the tone-coded message take priority, the tone flip-flop 7 also sets the tape recorder circuitry into motion. The tape head engage motor 21 is turned on, along with the forward motor 22, and the play/record circuitry 14 is set into the play mode. The pre-recorded audio message is activated and begins to play. The tone message one shot circuit 11 and the play enable circuit 23 disable or blank the audio message for the duration of the tone-coded message. As soon as the tone-coded message is completed, the play enable circuit 23 enables the pre-recorded audio message to be played. The play/record circuit 14 allows the pre-recorded message to be played for approximately 10 seconds at which time the recorder is automatically switched from the play to record modes. In the record mode, all room sounds are picked up by the microphone 24 and amplified by the preamplifier 25. This audio is both transmitted and recorded. It is transmitted for a preselected time period, i.e., for one minute. However, it is recorded for the duration of the cassette tape cartridge 26, or until it is manually turned off.

In summary, the alarm circuitry gives priority to the tone-coded message, allowing it to be transmitted first. The tone-coded message is immediately followed by the pre-recorded audio message for a period of approximately ten seconds, at which point the transmission of room sounds begins for a period of one minute. Upon completion of the room sound transmission, the transmitter 9 is automatically shut off. At this point, a repeat circuitry 27 retriggers the tone-coded message every thirty seconds. The tone-coded message is, therefore, transmitted every thirty seconds for the duration of the alarm. The repeat circuit 27 is reset by one of two methods, either by resetting the unit manually or upon reaching the end of the cassette tape 26.

This detector system is designed to function for both robbery and burglary, and in addition to being an alarm reporting system, it accumulates and retains evidence of the crime in the form of an audio recording and photographs.

The robbery mode of the system is triggered by one of two devices, i.e., a wireless pocket transmitter 30 or a wireless money clip transmitter 31. The activation of either of these transmitters 30–31 causes the money clip receiver 32 to initiate an alarm signal. It is noted that the money clip receiver 32 output connects to an OR circuit 33. The other input to the OR circuit 33 comes from a panic switch 34, commonly referred to as a "press to talk" switch. This panic switch 34 allows a person to be in one way communication with the police by simply pressing a button.

The intrusion/robbery flip-flop 35 is normally in the burglary mode. Either the money clip receiver 32 or the panic switch 34 will cause the intrusion/robbery flip-flop 35 to be set into the robbery mode. This will send a robbery command to the intrusion/robbery select circuit 16. In addition, the panic switch 34 will trigger the alarm flip-flop 6 through the panic flip-flop circuit 28 and long timed constant circuit 29 constituting a reset, which activates all of the alarm state circuitry.

Anytime the money clip receiver 32 is activated, the camera 36 begins taking a sequency of photographs. For example, a photograph can be taken every two seconds for a period of twenty seconds, and developed in a manner of minutes by using Polaroid equipment.

In summary, the robbery mode is triggered by either the money clip transmitter 31, pocket transmitter 30 or panic switch 34. The camera 36 is triggered by the money clip receiver 32 and takes photographs of the robbery. The tone-coded message, audio message, and "sounds from the scene" are transmitted by the RF transmitter 9. In addition, the audio recorder 14 tapes all room sounds and retains it as audio evidence.

To operate this detector system in the burglary mode, the stake-out unit is positioned as to be looking into a surveillance zone. A surveillance zone is defined as an area in which there is a high probability of an intruder passing through regardless of his point of entry into the building. Once the stake-out unit is set, the motion detectors 37 and 38 can be tested. The stake-out unit has two motion detectors, an ultrasonic motion detector 37 and a microwave motion detector 38. The motion detectors 37 and 38 have overlapping coverage patterns in the surveillance zone. To test the detectors 37–38, a test switch 40 is turned on, and movement causes an indicator to illuminate. If both the ultrasonic and microwave indicators 37–38 illuminate with walking motion through the coverage pattern, then the stake-out unit is tested and ready to operate the burglary mode.

To activate the stake-out unit, the motion enable switch 41 is turned on. The operator has 45 seconds to exit the immediate area of coverage without activating an alarm. When the 45 second exit delay circuit 42 has timed out, the stake-out unit is active and monitoring the surveillance zone. If an intruder walks through the coverage area and is detected by both the ultrasonic and microwave detectors 37–38, the alarm flip-flop 6 will be set through the motion alarm circuit 40. It is emphasized that the ultrasonic and microwave detectors 37–38 must detect motion before an alarm is transmitted. This requirement provides the redundancy necessary to allow either detector 37 or 38 to false alarm without triggering a transmission.

Resetting the motion enable switch 41 resets the alarm flip-flop 6 and activates the rewind motor 44 and drive 45 which rewinds the tape automatically, making it ready for the next day's operation.

A tamper switch 46 is provided to insure the integrity of the stake-out unit. If the unit is moved, after its initial installation, a siren 47 is activated through the siren circuit 50 and tamper flip-flop 51, and an alarm is transmitted. In addition, the tamper flip-flop 51 triggers a short timed constant circuit 52 which resets the transmitter 9 after the pre-recorded audio message. This eliminates the "sounds from the scene" transmission, since all that would be heard would be the siren 47. The long timed constant circuit 29 is activated in all cases except during the tamper mode.

The stake-out unit has standby rechargeable batteries for providing undisturbed protection during power failures. In the event that power is lost permanently, a self-diagnostic circuit 53 will trigger an alarm when the standby power reaches a critical low point.

The alarm sequence is unique in that it transmits a tone-coded message through the digital processor, followed by a pre-recorded audio message giving the address or location of the alarm to the police, followed by sounds from the scene. In addition, the tone-coded message is repeated every 30 seconds until someone responds or until the cassette tape has reached the end of tape and can no longer record audio.

The tone portion of the message is unique in that it is two-toned, time sequenced, multiple level, which provides extremely high odds against false triggering. The first pulse of the digital word consists of two tones which identify the type of alarm in progress, i.e., burglary or robbery. The second pulse consists of two tones which identify the "units" portion of the stake-out address. The third pulse consists of two tones which identify the "tens" portion of the stake-out address. The fourth pulse consists of the sub-unit address. All four "two-toned" pulses must be detected in the proper time sequence to be considered a valid message.

The recorder automatically rewinds, and upon alarm it plays a pre-recorded message. Upon completion of the pre-recorded message, it automatically and electronically switches to record mode in order to gather audio evidence. All room sounds are recorded on tape following an alarm. The pre-recorded message is programmable by simply pressing a program button followed by speaking the desired pre-recorded message in a normal tone of voice. The digital address can be programmed by simply selecting switch positions. Upon a robbery alarm, the stake-out unit records audio evidence and causes the camera to take photographs which can be in color and developed for viewing when the responding officer arrives at the scene.

When used in the burglary mode, it is required that motion detection from the ultrasonic detector 37 and microwave detector 38 be received before an alarm is transmitted. This allows either detector 37–38 to false alarm without actually transmitting an alarm.

The stake-out unit is self-diagnostic to a point that if it is tampered with, or if the standby battery power becomes low, the unit will transmit for help.

The stake-out unit can be triggered, in the event of armed robbery by a wireless cash drawer transmitter (not shown). In fact, a plurality of cash drawer transmitters can be used and the system can discriminate between and identify the one that triggers the alarm.

The transmitted tone-coded message consists of four pulses, each pulse containing two tones commonly referred to as a tone pair. The tone pair consists of one tone from the low band and one tone from the high band. The low band tones are 697 hz, 770 hz, 852 hz and 941 hz. These are four discreet audio frequencies. The high band tones consist of 1209 hz, 1336 hz, and 1477 hz. Again, these are three discreet audio frequencies. Therefore, as an example, a tone pair could consist of a combination of 941 hz and 1209 hz. It could just as easily consist of a combination of 697 hz and 1336 hz. Any low and high tone can be combined into a tone pair. The table above shows that with the four low tones and three high tones, there are 12 possible combinations of tone pairs.

Figure 3:
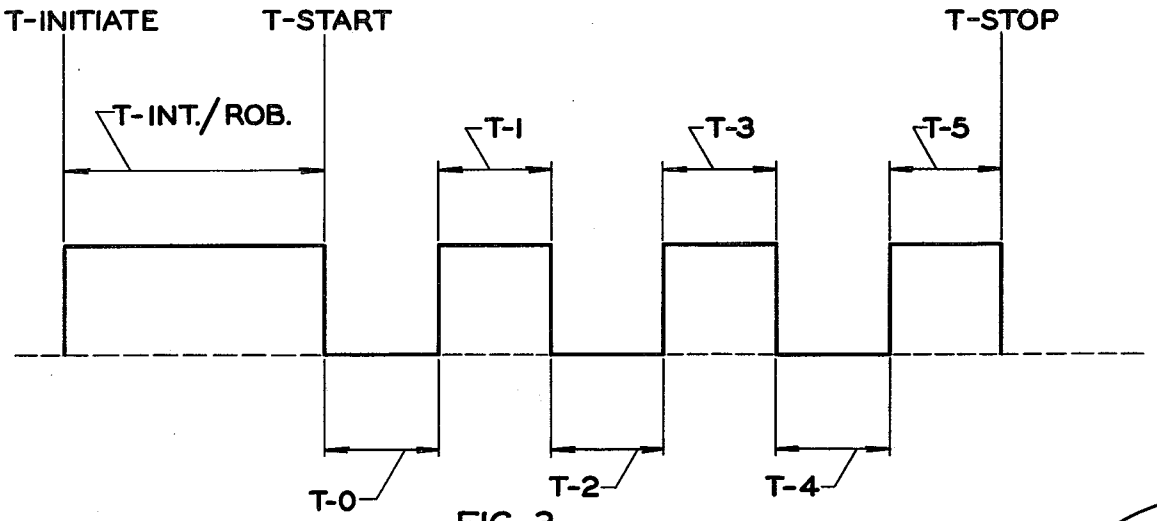
FIG. 3 is a diagram of the input message structure received by the processor.

The tone-coded message which is transmitted by the stake-out unit and received by the processor, is structured as shown in FIG. 3. There are four pulses, each pulse containing its own tone pair. The first is a long pulse, followed by three short pulses. These four pulses constitute a digital word. Each time a tone-coded message is transmitted, the same word is repeated twice; therefore, a tone-coded message consists of two identical digital words.

In addition to the four, tone pair pulses occurring, they must occur in a particular, preset time frame. The first tone pair pulse is 300 milliseconds in length, and is followed by a 100 millisecond space or silence, followed by a 100 millisecond tone pair pulse, followed by a 100 millisecond space, followed by another 100 millisecond tone pair pulse, followed by a 100 millisecond space, and followed by a final 100 millisecond tone pair pulse.

The first pulse contains the "type of alarm" information, i.e., alarmed because of robbery or alarmed because of burglary. For example, robbery alarm pulse will always contain the tone pair of 641 hz and 1209 hz. The burglary alarm pulse will always contain the tone pair of 941 hz and 1477 hz. These two tone pairs are set aside for use during the first tone pair pulse. Because two tone pairs are set aside, of the remaining twelve combinations originally available, only 10 pairs now remain for further use in the message. The remaining 10 pairs are designated identifiers of 0 through 9 which constitute the decimal system. The next two tone pair pulses contain the stake-out unit identifier or address. These two tone pair pulses, depending upon the tone pairs chosen, can identify units numbered from 00 to 99 or a total of 100 different addresses. These two tone pair address pulses follow the "type of alarm" pulse. The first address pulse identifies the "units" column of the number, i.e., in the address "17", the first pulse would contain a tone pair corresponding to a "7" or 852 hz and 1336 hz. The second address pulse identifies the tens column of the number, i.e., in the same address numbered "17", the second pulse would contain a tone pair corresponding to a "1" or 687 hz and 1336 hz.

The fourth and final pulse tone pair is called the valid pulse. This fourth pulse must occur as a coded number "1" through "5" or the message will be considered invalidated by the processor.

The above description defines the message structure transmitted by the stake-out unit when it is set into an alarm by either an armed robbery or a burglary. This defines the initiating portion of the RF link. The receiving half of the RF link is defined as a processor operation. The processor signal handling contains five major components; a receiver, signal conditioning amplifier, tone decoders, and a readout.

The receiver 60 is fixed frequency RF receiver that is crystal tuned to the same frequency being transmitted by the stake-out units. The receiver 60 is on and listening for a message at all times. Any incoming tones or sound of any kind are received. The function of the processor is to hear and recognize only the valid messages generated by the stake-out units, and discriminate against all other voice, tones and noise being received on that particular frequency.

The processor is keyed into the listening mode by receiving either a robbery or burglary tone pair pulse. It is remembered that the first tone pair pulse is 300 milliseconds in duration. The decoder of this signal requires that the pulse be present for a minimum of 200 milliseconds. If the pulse tone pair does not persist for 200 milliseconds, the processor ignores the message and continues to listen for a valid message. This feature keeps the processor circuitry from even being activated unless the probability is high that the following message is valid.

If on the other hand, the initializing tone pair does persist for the required 200 milliseconds, the decoders will activate and provide a logic "start" signal at the end of the 300 millisecond tone pair pulse. The "start" signal does not in itself constitute a valid message. It simply starts the circuitry in motion to be looking for and testing for a valid message.

At this point the processor has recognized and stores the fact that a robbery or burglary pulse has occurred. It also sets into motion, the timing circuitry to require the remaining three tone pair pulses to occur in the correct time sequence.

The "start" signal sets a one shot multi-vibrator 61 which is simply a timing gate that allows the processor to look for additional pulses for a period of 600 milliseconds. If the remaining pulses do not occur within this time frame, the processor resets to the listening mode. In addition to the "start" signal setting the time gate 61, it also starts a clock 62 which is an astable multi-vibrator with a time period of 100 milliseconds. This 100 millisecond rate clock 62 provides the clock input to a decade counter 63 acting as a manifold from which pulses are taken from the output number 1, 3 and 5. The output number (1) pulse occurs after 100 milliseconds, the output number (3) pulse occurs after 300 milliseconds and the output number (5) pulse occurs after 500 milliseconds. These three outputs provide the timing requirements for the three tone pair pulses which occur after the "type of alarm" pulse.

The incoming units pulse must in addition to containing two proper tones, must occur within the 100 millisecond and 200 millisecond time slot, the tens pulse must occur within the 300 millisecond and 400 millisecond time slot, and the valid pulse must occur within the 500 millisecond and 600 millisecond time slot. If and only if, the three tone pair pulses contain correct tones to pass the decode test, and occur in the proper time intervals to pass the time sequence requirement, will a valid message be registered and the readouts be activated.

Once a valid message is received, the alarm is registered in the memory matrix of light-emiting diodes. In addition to being registered in the memory matrix, a digital readout displays the unit number. If a second alarm is received, the digital readout will update to read the last alarm number having been received, and in addition the new alarm will be added to the memory matrix.

The tone-decoding sequence begins with an incoming signal being picked up by the receiver 60. The audio output of this receiver 60 contains the two-tone pulses shown in FIG. 3. The audio tone message is presented on a buss which connects the phase-lock loop tone decoder inputs together. The tone decoders TD-1 through TD-14 all receive the same tone message.

Figure 4:
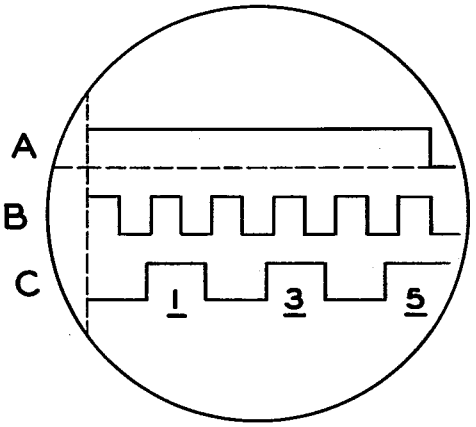
FIG. 4 is a diagram of the various pulses provided by the processor circuitry.

The tone pair pulse occurring during the intrusion/-robbery time period, as shown in FIG. 3, will always contain 941 hz with either 1209 hz or 1477 hz. These tones will be decoded by TD-4 and TD-5 or TD-4 and TD-7. In either case, the burglary circuit 64 or robbery circuit 65 will be set. Either one of these circuits 64–65 being triggered will set the start one shot circuit 61. The output pulse of the start one shot circuit 61 is depicted as wave form A in FIG. 4. This pulse A has two functions, it enables all of the flip-flop circuits FF-1 through FF-16. The flip-flops FF-1 through FF-16 could not be set until the first pulse of the message structure was recognized.

The second function of the start one shot circuit 61 is to enable the 100 millisecond clock 62. The clock output is depicted by wave from B in FIG. 4. This clock 62 provides the input to the decade counter 63. The output of the decade counter 63 is depicted in wave form C in FIG. 4. A pulse is present at output line number (1) during the period T1. Another pulse is present at output line number (3) during the period T3. Another pulse is present at output line number (5) during the period T5. The pulse during period T1 enables gates A-1 through A-10. If a tone pair is present during this time period T1, a flip-flop FF-1 through FF-10 would be set. The pulse during time period T3 enables gates A-11 and A-12. If a tone pair is present during this time period T3, the flip-flop FF-11 or FF-12 could be set. The pulse occurring during time period T5 enables gates A-13 through A-16. If a tone pair is present during this time period T5, a flip-flop FF-13 through FF-16 could be set.

An example of a message routed through the matrix is now described. During the pulse occurring at time T1, two tone decoders received a valid tone which gives gate A-1 the three necessary inputs to allow flip-flop FF-1 to be set. It will be noticed that the logic signal from flip-flop FF-1 is presented to both matrix gate M-1 and M-11 to allow time for a second or third pulse to occur.

During the time period T3, two tones occur which provide the necessary inputs to gate A-11 which in turns sets flip-flop FF-11. The output of FF-11 is presented to all matrix gates M-1 through M-10. This provides only the second of the three required inputs to register an alarm.

During the time period T5, two tones occur which provide the necessary inputs to gate A-13 which in turns sets flip-flop FF-13. The output of flip-flop FF-13 is presented to all matrix gates M-1 through M-20. This provides the third and final requirement to constitute a valid signal. Many of the matrix gates will have one or two requirements met, but only gate M-1 has all three requirements for a valid signal. Therefore, matrix gate M-1 triggers the alarm indicator.

We claim as our invention:

1. An intrusion detector system comprising:

(a) means for transmitting an alarm signal, (b) means operative to receive the alarm signal and to provide an electric signal in response thereto, (c) means operative in response to the electric signal to provide a predetermined number of pulses having predetermined time periods, (d) a tone generator operative in response to the pulses for generating multiple tones of discreetly different frequencies during each pulse to provide a tone-coded message, each generator pulse having a combination of multiple tones of different frequencies than the combination of multiple tones of each other generator pulse, (e) means operative to transmit the tone-coded message, (f) the means for transmitting an alarm signal including:

(1) a robbery transmitter that is directly activated to provide a first alarm signal, and (2) an intrusion transmitter for transmitting a signal into a zone under surveillance and receiving a signal from the zone to provide a second alarm signal in response thereto, (g) the means providing the timed pulses is activated by the second alarm signal, and (h) means receiving the timed pulses and activating the tone generator to provide a multiple tone combination during one timed pulse to indicate a burglary, and receiving the first alarm signal and activating the tone generator to provide a different multiple tone combination during the said one-timed pulse to indicate a robbery.

2. An intrusion detector system as defined in claim 1, in which:

(i) a camera is operative in response to the first alarm signal to photograph the robbery zone.

3. An intrusion detector system comprising:

(a) means for transmitting an alarm signal, (b) means operative to receive the alarm signal and to provide an electric signal in response thereto, (c) means operative in response to the electric signal to provide a predetermined number of pulses having predetermined time periods, (d) a tone generator operative in response to the pulses for generating multiple tones of discreetly different frequencies during each pulse to provide a tone-coded message, each generator pulse having a combination of multiple tones of different frequencies than the combination of multiple tones of each other generator pulse, (e) means operative to transmit the tone-coded message, (f) the means for transmitting an alarm signal including:

(1) a robbery transmitter that is directly activated to provide a first alarm signal, and (2) an intrusion transmitter for transmitting a signal into a zone under surveillance and receiving a signal from the zone to provide a second alarm signal in response thereto, (g) the means providing the timed pulses is activated by the second alarm signal, (h) means receiving the timed pulses and activating the tone generator to provide a multiple tone combination during one timed pulse to indicate a burglary, and receiving the first alarm signal and activating the tone generator to provide a different multiple tone combination during the said one timed pulse to indicate a robbery, (i) a camera operative in response to the first alarm signal to photograph the robbery zone, and (j) a recording means operative in response to the second alarm signal for transmitting a pre-recorded message after transmission of the tone-coded message and for recording all sounds in the surveillance zone.

4. An intrusion detector system, comprising:

(a) means operative for transmitting an alarm signal, (b) means operative for receiving the alarm signal and to provide a predetermined number of pulses having predetermined time periods, (c) a tone generating and control means receiving the timed pulses and generating a combination of multiple tones of discreetly different frequencies during the timed pulses, the combination of multiple tones of each timed pulse being of different frequencies than the combination of multiple tones of each other timed pulse, to provide a tone-coded message, (d) means operative to transmit the tone-coded message, (e) a receiver operative to receive the tone-coded message, (f) means operative in response to the reception of the first multiple tone, timed pulse of the tone-coded message for providing an electrical start signal, (g) means operative in response to the electrical start signal to provide a predetermined number of pulses having predetermined time periods compatible with the other pulses of a valid tone-coded message so as to have substantially coincident time frames in order to validate the tone-coded message, and (h) gating means operative in response to the particular combination of multiple tones present in each substantially coincident time frame in time sequence to provide an output alarm indication.

5. An intrusion detector system as defined in claim 4, in which:

(i) a timing gate means is operative in response to the electrical start signal for providing a predetermined time period in which the other pulses of the tone-coded message must be received.

6. An intrusion detector system, comprising;

(a) means operative for transmitting an alarm signal, (b) means operative for receiving the alarm signal and to provide a predetermined number of pulses having predetermined time periods, (c) a tone generating and control means receiving the timed pulses and generating a combination of multiple tones of discreetly different frequencies during the timed pulses, the combination of multiple tones of each timed pulse being of different frequencies than the combination of multiple tones of each other timed pulse, to provide a tone-coded message, (d) means operative to transmit the tone-coded message, (e) a receiver operative to receive the tone-coded message, and (f) means operative in response to the initial reception of the tone-coded message by the receiver to provide a predetermined number of pulses having predetermined time periods compatible with the pulses of a valid tone-coded message so as to have substantially coincident time frames during which appropriate multiple tones can be present in order to validate the tone-coded message, and operative in response to a particular combination of multiple tones present in each time frame in sequence to provide an output alarm indication.

* * * * *

UNITED STATES PATENT AND TRADEMARK OFFICE

CERTIFICATE OF CORRECTION

PATENT NO. : 4,166,273

DATED : August 28, 1979

INVENTOR(S) : Robert E. Riley, Jr., et al

It is certified that error appears in the above-identified patent and that said Letters Patent are hereby corrected as shown below:

In the heading of column 1 of the front page, in the address of the inventors, cancel "Mich." and substitute --Mississippi--.

Under the address of the assignee, cancel "Mich." and substitute --Mississippi--.

Signed and Sealed this

*Nineteenth* Day of *May 1981*

[SEAL]

*Attest:*

RENE D. TEGTMEYER

*Attesting Officer*

*Acting Commissioner of Patents and Trademarks*